US006673528B2

(12) United States Patent
Haye et al.

(10) Patent No.: US 6,673,528 B2
(45) Date of Patent: Jan. 6, 2004

(54) ASCORBIC ACID DEVELOPING COMPOSITIONS CONTAINING SUGAR AND METHODS OF USE

(75) Inventors: Shirleyanne E. Haye, Rochester, NY (US); Janet M. Huston, Webster, NY (US); Jacques Roussilhe, Virey le Grand (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/349,605

(22) Filed: Jan. 23, 2003

(65) Prior Publication Data

US 2003/0152876 A1 Aug. 14, 2003

Related U.S. Application Data

(62) Division of application No. 09/643,319, filed on Aug. 21, 2000, now abandoned.

(51) Int. Cl.[7] ..... G03C 5/305
(52) U.S. Cl. ..... 430/490
(58) Field of Search ..... 430/490

(56) References Cited

U.S. PATENT DOCUMENTS

| | | | | |
|---|---|---|---|---|
| 3,576,633 | A | 4/1971 | Henn et al. | 430/355 |
| 3,658,527 | A | 4/1972 | Kunz et al. | 430/234 |
| 4,427,762 | A | 1/1984 | Takahashi et al. | 430/436 |
| 4,569,904 | A | 2/1986 | Okutsu et al. | 430/434 |
| 4,756,997 | A | 7/1988 | Marchesano | 430/478 |
| 4,824,774 | A | 4/1989 | Inoue et al. | 430/566 |
| 4,839,259 | A | 6/1989 | Sasaoka et al. | 430/264 |
| 5,196,298 | A | 3/1993 | Meeus et al. | 430/440 |
| 5,232,823 | A | 8/1993 | Morimoto et al. | 430/438 |
| 5,342,741 | A | 8/1994 | Morimoto et al. | 430/490 |
| 5,419,997 | A | 5/1995 | Hirano | 430/264 |
| 5,503,965 | A | 4/1996 | Okutsu | 430/399 |
| 5,508,152 | A | 4/1996 | Toyoda, et al. | 430/436 |
| 5,578,433 | A | 11/1996 | Morishima et al. | 430/436 |
| 5,702,875 | A | 12/1997 | Opitz et al. | 430/492 |
| 5,738,979 | A | 4/1998 | Fitterman et al. | 430/399 |
| 5,780,212 | A | 7/1998 | Roussilhe et al. | 430/466 |
| 5,821,040 | A | 10/1998 | Okutsu et al. | 430/440 |
| 5,821,041 | A | 10/1998 | Okutsu et al. | 430/440 |
| 5,824,458 | A | 10/1998 | Okutsu et al. | 430/490 |
| 5,834,171 | A | 11/1998 | Suzuki et al. | 430/465 |
| 5,837,434 | A | 11/1998 | Roussilhe et al. | 430/480 |
| 5,942,379 | A | 8/1999 | Roussilhe et al. | 430/480 |
| 5,976,758 | A | 11/1999 | Fukui et al. | 430/264 |
| 5,994,040 | A | 11/1999 | Morishima et al. | 430/436 |
| 6,001,546 | A | 12/1999 | Suzuki et al. | 430/548 |
| 6,033,836 | A | 3/2000 | Fitterman et al. | 430/438 |

FOREIGN PATENT DOCUMENTS

| | | |
|---|---|---|
| EP | 0 531 582 A1 | 3/1993 |
| EP | 0 785 467 A1 | 1/1997 |
| FR | 2170850 | 11/1972 |

*Primary Examiner*—Hoa Van Le
(74) *Attorney, Agent, or Firm*—J. Lanny Tucker

(57) ABSTRACT

A black-and-white photographic developing composition has improved stability and is more compatible with the environment when discarded. The composition includes one or more ascorbic acid developing agents and is essentially free of hydroquinone and similar developing agents. It comprises a mono- or disaccharide such as ribose, fructose, lactose, glucose or galactose as a stabilizing agent for the developing agent.

11 Claims, 1 Drawing Sheet

ASCORBIC ACID DEVELOPING COMPOSITIONS CONTAINING SUGAR AND METHODS OF USE

CROSS-REFERENCE TO RELATED APPLICATION

This is a Divisional of application Ser. No. 09/643,319 filed Aug. 21, 2000, now abandoned.

FIELD OF THE INVENTION

This invention relates in general to photography and in particular to improved black-and-white developing compositions. More particularly, it relates to improved and stabilized ascorbic acid developing compositions and to methods for their use in processing photographic silver halide materials.

BACKGROUND OF THE INVENTION

Photographic black-and-white developing compositions containing a silver halide black-and-white developing agent are well known in the photographic art for reducing silver halide grains containing a latent image to yield a developed photographic image. Many useful developing agents are known in the art, with hydroquinone and similar dihydroxybenzene compounds and ascorbic acid (and derivatives) being some of the most common. Such compositions generally contain other components such as sulfites, buffers, antifoggants, halides and hardeners.

Dihydroxybenzenes (such as hydroquinone) are the most common black-and-white developing agents and are quite active to provide development in various black-and-white photographic elements with or without booster and nucleating compounds. However, they are disadvantageous from several technical and environmental considerations. For example, hydroquinone compositions are not completely stable in air, being prone to aerial oxidation. The by-products from instability are often insoluble, black and tarry materials that contaminate the processing solutions and equipment.

The oxidation of hydroquinones also leads to higher pH that in turn leads to increased developer activity. Images can be produced faster so the processing time must be reduced. The net effect is less control of the process, and less desirable sensitometric properties in the processed materials.

In addition, hydroquinones have become an increasing concern from the point of view of potential toxicity and environmental pollution.

Another class of black-and-white developing agents are known in many publications as ascorbic acid and its various derivatives, for example as described in U.S. Pat. No. 5,236,816 (Purol et al). While these types of developing agents are considerably more suitable to the environment, a major concern with ascorbic acid type developing agents is their stability to aerial oxidation. It is well known to improve stability of hydroquinone developing agents by means of various additives, as described in U.S. Pat. No. 4,756,997 (Marchesano), for processing high contrast graphic arts films.

There is a need however for more stable ascorbic acid developing compositions for processing a wide variety of photographic silver halide materials that require a black-and-white developing step.

SUMMARY OF THE INVENTION

An improved black-and-white photographic developing composition that is essentially free of dihydroxybenzene compounds and comprises:

a) an ascorbic acid developing agent, and b) a stabilizing amount of a mono- or disaccharide.

This invention also provides a method of providing an image comprising contacting an imagewise exposed photographic silver halide material with the black-and-white photographic developing composition described above for at least 10 seconds.

This invention also provides a photoprocessing kit comprising the black-and-white developing composition described above, and one or more additional photochemical processing compositions.

The present invention provides a highly stabilized black-and-white developing composition by the use of the mono- or disaccharide as a stabilizing agent. This composition is also essentially free of dihydroxybenzene compounds such as hydroquinone and its derivatives.

In addition, the activity of the developing compositions of this invention can be suitably maintained using a replenisher composition that has essentially the same components, concentrations and pH. In effect, the replenisher composition is equally stable as the working composition.

Because the compositions of this invention have increased stability, they can be used as lower replenishment rates during photoprocessing. This would lead to lower effluent volumes and costs. In addition, a certain amount of mono- or disaccharide from the developing step can be carried over into a later processing bath, such as a photographic fixing bath.

The improved stability (that is, reduced aerial oxidation) would generally reduce composition color change.

DETAILED DESCRIPTION OF THE INVENTION

Figure 1:
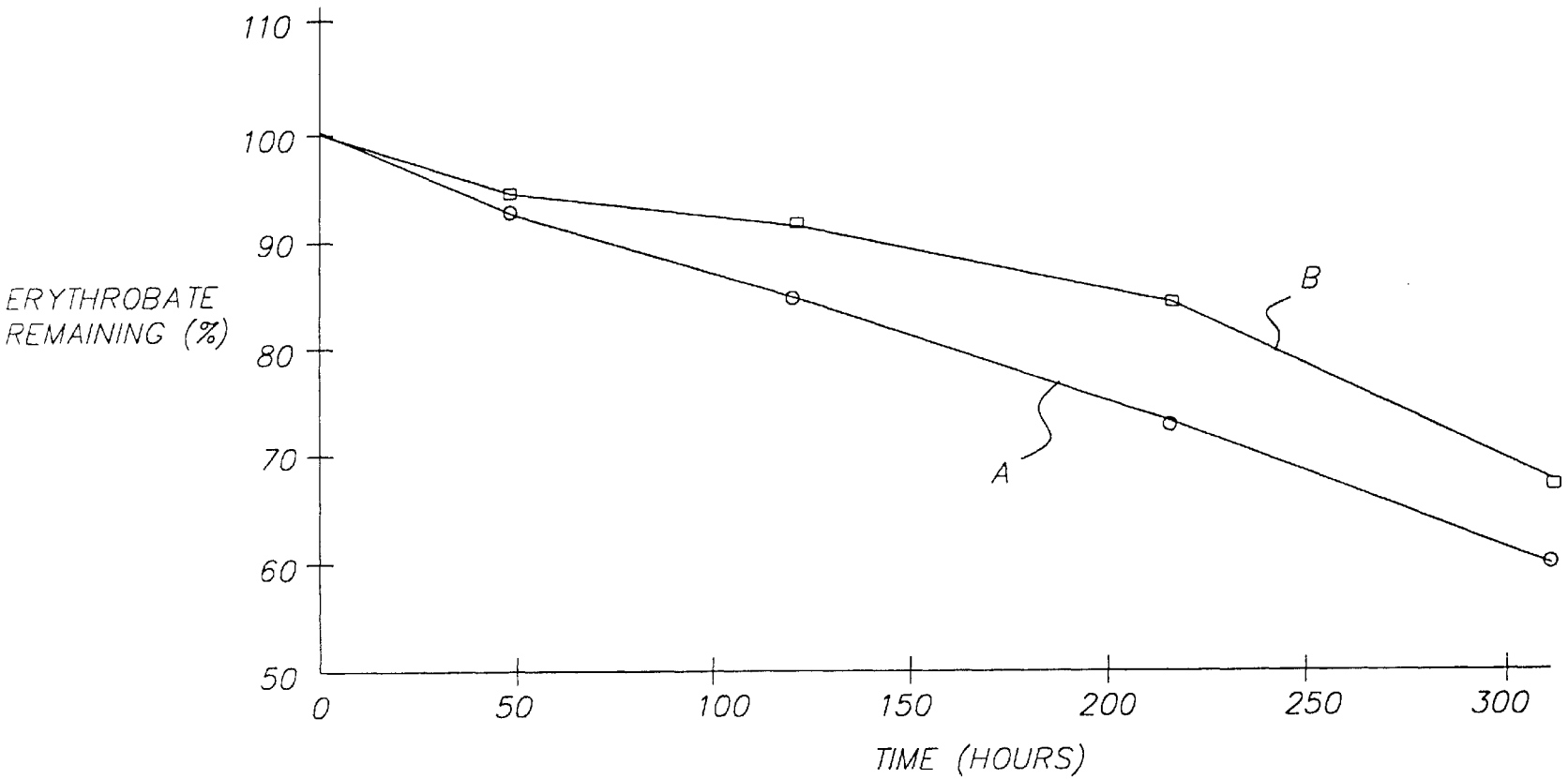
FIG. 1 is a graphical representation of stabilization data generated for Example 1 below.

The present invention is useful for black-and-white development in any photographic silver halide material requiring at least one black-and-white development step. Such types of silver halide materials include, but are not limited to, particularly, radiographic films, aerial films, black-and-white motion picture films, duplicating and copy films, graphic arts films, positive- and negative-working microfilms and amateur and professional continuous tone black-and-white films. The general composition of such materials is well known in the art but specific features that render them particularly adaptable to the present invention are described below in more detail.

In addition, the black-and-white developing composition of this invention can be used in the "first" (black-and-white) development of color reversal photographic silver halide materials (details described below).

The black-and-white developing compositions of this invention contain one or more ascorbic acid developing agents. An "ascorbic acid" developing agent means ascorbic acid and derivatives thereof. Ascorbic acid developing agents are described in a considerable number of publications in photographic processes, including U.S. Pat. No. 5,236,816 (noted above) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al), EP-A-0 585,792 (published Mar. 9, 1994), EP-A-0 573 700 (published Dec. 15, 1993), EP-A-0 588 408 (published Mar. 23, 1994), WO 95/00881 (published Jan. 5, 1995), U.S. Pat. Nos. 5,089,819 and 5,278,035 (both of Knapp), U.S. Pat. No. 5,384,232 (Bishop et al), U.S. Pat. No. 5,376,510 (Parker et al), Japanese Kokai 7-56286 (published Mar. 3, 1995), U.S. Pat. No. 2,688,549 (James et al), U.S. Pat. No. 5,236,816 (noted above) and *Research Disclosure*, publication 37152, March 1995. D-, L-, or D,L-ascorbic acid (and alkali metal salts thereof) or isoascorbic acid (or alkali metal salts thereof) are preferred. Sodium ascorbate and sodium isoascorbate are most preferred. Mixtures of these developing agents can be used if desired.

The black-and-white developing composition can also include one or more auxiliary co-developing agents that are also well known (for example, Mason, *Photographic Processing Chemistry,* Focal Press, London, 1975). Any auxiliary developing agent can be used, but the 3-pyrazolidone developing agents are preferred (also known as "phenidone" type developing agents). Such compounds are described, for example, in U.S. Pat. No. 5,236,816 (noted above). The most commonly used compounds of this class are 1-phenyl-3-pyrazolidone, 1-phenyl-4,4-dimethyl-3-pyrazolidone, 4-hydroxymethyl-4-methyl-1-phenyl-3-pyrazolidone, 5-phenyl-3-pyrazolidone, 1-p-aminophenyl-4,4-dimethyl-3-pyrazolidone, 1-p-tolyl-4,4-dimethyl-3-pyrazolidone, 1-p-tolyl-4-hydroxymethyl-4-methyl-3-pyrazolidone, and 1-phenyl-4,4-dihydroxymethyl-3-pyrazolidone. Other useful auxiliary co-developing agents comprise one or more solubilizing groups, such as sulfo, carboxy or hydroxy groups attached to aliphatic chains or aromatic rings, and preferably attached to the hydroxymethyl function of a pyrazolidone, as described for example, in U.S. Pat. No. 5,837,434 (Roussilhe et al). A most preferred auxiliary co-developing agent is 4-hydroxymethyl-4-methyl-1-phenyl-3-pyrazolidone.

Less preferred auxiliary co-developing agents include aminophenols such as p-aminophenol, o-aminophenol, N-methylaminophenol, 2,4-diaminophenol hydrochloride, N-(4-hydroxyphenyl)glycine, p-benzylaminophenol hydrochloride, 2,4-diamino-6-methylphenol, 2,4-diaminoresorcinol and N-(β-hydroxyethyl)-p-aminophenol.

A mixture of different types of auxiliary developing agents can also be used if desired.

An organic or inorganic antifoggant is also preferably present in the black-and-white developing composition, either singly or in admixture. Such compounds control the gross fog appearance in the processed elements. Useful inorganic antifoggants include various halide salts, including bromides. Suitable organic antifoggants include, but are not limited to, benzimidazoles, benzotriazoles, mercaptotetrazoles, indazoles and mercaptothiadiazoles. Representative antifoggants include 5-nitroindazole, 5-p-nitrobenzoylaminoimidazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-(2-mercapto-1,3,4-thiadiazol-2-yl-thio)butanesulfonate, 5-amino-1,3,4-thiadiazol-2-thiol, 5-methylbenzotriazole, benzotriazole and 1-phenyl-5-mercaptotetrazole. Benzotriazole is most preferred.

The developing composition also includes one or more preservatives or antioxidants. Both organic and inorganic preservatives can be used. Useful organic preservatives include hydroxylamine and its various aryl and alkyl derivatives. Sulfites are preferred inorganic preservatives. A "sulfite" preservative is used herein to mean any sulfur compound that is capable of forming or providing sulfite ions in aqueous alkaline solution. Examples include, but are not limited to, alkali metal sulfites, alkali metal bisulfites, alkali metal metabisulfites, amine sulfur dioxide complexes, sulfurous acid and carbonyl-bisulfite adducts. Mixtures of these materials can also be used.

Examples of preferred sulfites include sodium sulfite, potassium sulfite, lithium sulfite, sodium bisulfite, potassium bisulfite, sodium metabisulfite, potassium metabisulfite, and lithium metabisulfite. The carbonyl-bisulfite adducts that are useful include alkali metal or amine bisulfite adducts of aldehydes and bisulfite adducts of ketones. Examples of these compounds include sodium formaldehyde bisulfite, sodium acetaldehyde bisulfite, succinaldehyde bis-sodium bisulfite, sodium acetone bisulfite, β-methyl glutaraldehyde bis-sodium bisulfite, sodium butanone bisulfite, and 2,4-pentandione bis-sodium bisulfite.

Various known buffers, such as borates, carbonates and phosphates, or combinations of any of these can be included in the compositions to maintain the desired pH when in aqueous form. The pH can be adjusted with a suitable base (such as a hydroxide) or acid. The pH of the developing composition (in aqueous form) is generally from about 7 to about 12, and more preferably from about 8 to about 11.

Optionally, the black-and-white developing composition contains one or more sequestering agents that typically function to form stable complexes with free metal ions or trace impurities (such as silver, calcium, iron and copper ions) in solution that may be introduced into the developing composition in a number of ways. The sequestering agents, individually or in admixture, are present in conventional amounts. Many useful sequestering agents are known in the art, but particularly useful classes of compounds include, but are not limited to, multimeric carboxylic acids, polyphosphonic acids and polyaminophosphonic acids, and any combinations of these classes of materials as described in U.S. Pat. No. 5,389,502 (Fitterman et al), aminopolycarboxylic acids, polyphosphate ligands, ketocarboxylic acids, and alkanolamines. Representative sequestering agents include ethylenediaminetetraacetic acid, diethylenetriaminepentaacetic acid, 1,3-propylenediaminetetraacetic acid, 1,3-diamino-2-propanoltetraacetic acid, ethylenediaminodisuccinic acid, ethylenediaminomonosuccinic acid, 4,5-dihydroxy-1,3-benzenedisulfonic acid, disodium salt (TIRON™), N,N'-1,2-ethanediylbis{N-[(2-hydroxyphenyl)methyl]}glycine ("HBED"), N-{2-[bis(carboxymethyl)amino]ethyl}-N-(2-hydroxyethyl)glycine ("HEDTA"), N-{2-[bis(carboxymethyl)amino]ethyl}-N-(2-hydroxyethyl)glycine, trisodium salt (available as VERSENOL™ from Acros Organics, Sigma Chemical or Callaway Chemical), and 1-hydroxyethylidenediphosphonic acid (available as DEQUEST™ 2010 from Solutia Co.).

The black-and-white developing composition can contain other additives including various development restrainers, development accelerators, swelling control agents, dissolving aids, surface active agents, colloid dispersing aids, restrainers (such as sodium or potassium bromide), and sludge control agents (such as 2-mercaptobenzothiazole, 1,2,4-triazole-3-thiol, 2-benzoxazolethiol and 1-phenyl-5-mercatoetrazole), each in conventional amounts, each in conventional amounts. Examples of such optional components are described in U.S. Pat. No. 5,236,816 (noted above), U.S. Pat. No. 5,474,879 (Fitterman et al), U.S. Pat. No. 5,837,434 (Roussilhe et al), Japanese Kokai 7-56286 and EP-A-0 585 792.

The composition of this invention can also include one or more fixing agents (described below) to provide what is known in the art as a "monobath".

The developing compositions of this invention are essentially free of dihydroxybenzene compounds (such as hydroquinone). By "essentially free" is meant that such compounds are not purposely added and may be inadvertently present in an amount of less than 0.0001 mol/l.

The developing composition preferably includes one or more monosaccharides or disaccharides as the stabilizing agents. Representative stabilizing agents include, but are not limited to, D- or L-ribose, D- or L-fructose, D- or L-lactose, D-glucose and D-galactose. D- or L-Ribose is preferred. Individual isomers or racemic mixtures of each stabilizing agent can be used. Mixtures of different stabilizing agents can be used if desired.

The essential (and some optional) components described above are present in the aqueous developing compositions in the general and preferred amounts listed in Table I, all minimum and maximum amounts being approximate (that is, "about"). If formulated in dry form, the compositions would have the essential components in amounts readily apparent to one skilled in the art suitable to provide the desired liquid concentrations.

TABLE I

| Developing Composition | General Amount | Preferred Amount |
|---|---|---|
| Ascorbic acid developing agent | 0.01 to 0.6 mol/l | 0.05 to 0.3 mol/l |
| Auxiliary Co-developing agent | 0.0001 to 0.08 mol/l | 0.01 to 0.04 mol/l |
| Antifoggant | 0.0001 to 0.01 mol/l | 0.0005 to 0.002 mol/l |
| Preservative (e.g. sulfite ions) | 0 to 1 mol/l | 0 to 0.5 mol/l |
| Buffer | 0.001 to 1 mol/l | 0.3 to 0.8 mol/l |
| Mono- or disaccharide stabilizing agent | 0.01 to 0.5 mol/l | 0.05 to 0.25 mol/l |

Within the noted general and preferred ranges, the molar ratio of the stabilizing agent to ascorbic acid developing agent is generally from about 0.05:1 to about 2.5:1, and preferably from about 0.125:1 to about 1:1.

In most processing methods in which the developing composition of this invention is used, its use is generally followed by a fixing step using a photographic fixing composition containing a photographic fixing agent. While sulfite ion sometimes acts as a fixing agent, the fixing agents generally used are thiosulfates (including sodium thiosulfate, ammonium thiosulfate, potassium thiosulfate and others readily known in the art), cysteine (and similar thiol containing compounds), mercapto-substituted compounds (such as those described by Haist, *Modern Photographic Processing,* John Wiley & Sons, N.Y., 1979), thiocyanates (such as sodium thiocyanate, potassium thiocyanate, ammonium thiocyanate and others readily known in the art), amines or halides. Mixtures of one or more of these classes of photographic fixing agents can be used if desired. Thiosulfates and thiocyanates are preferred. In some embodiments, a mixture of a thiocyanate (such as sodium thiocyanate) and a thiosulfate (such as sodium thiosulfate) is used. In such mixtures, the molar ratio of a thiosulfate to a thiocyanate is from about 1:1 to about 1:10, and preferably from about 1:1 to about 1:2. The sodium salts of the fixing agents are preferred for environmental advantages.

The fixing composition can also include various addenda commonly employed therein, such as buffers, fixing accelerators, sequestering agents, swelling control agents, and stabilizing agents, each in conventional amounts. In its aqueous form, the fixing composition generally has a pH of at least 4, preferably at least 4.5, and generally less than 6, and preferably less than 5.5.

The developing and fixing compositions useful in the practice of this invention can be provided in dry or aqueous form, and can be prepared by dissolving or dispersing the components in water and adjusting the pH to the desired value. The compositions can also be provided in concentrated form, and diluted to working strength just before use, or during use. The components of the compositions can also be provided in a kit of two or more parts to be combined and diluted with water to the desired strength and placed in the processing equipment. The compositions can be used as their own replenishers, or another similar solutions can be used as the replenishers.

Processing can be carried out in any suitable processor or processing container for a given type of photographic element (for example, sheets, strips or rolls). The photographic material is generally bathed in the processing compositions for a suitable period of time.

In processing black-and-white photographic materials, development and fixing are preferably, but not essentially, followed by a suitable washing step to remove silver salts dissolved by fixing and excess fixing agents, and to reduce swelling in the element. The wash solution can be water, but preferably the wash solution is acidic, and more preferably, the pH is 7 or less, and preferably from about 4.5 to about 7, as provided by a suitable chemical acid or buffer.

After washing, the processed elements may be dried for suitable times and temperatures, but in some instances the black-and-white images may be viewed in a wet condition.

For example, exposure and processing of radiographic films can be undertaken in any convenient conventional manner. The exposure and processing techniques of U.S. Pat. Nos. 5,021,327 and 5,576,156 (both noted above), are typical for processing radiographic films. Other processing compositions (both developing and fixing compositions) are described in U.S. Pat. No. 5,738,979 (Fitterman et al), U.S. Pat. No. 5,866,309 (Fitterman et al), U.S. Pat. No. 5,871,890 (Fitterman et al), U.S. Pat. No. 5,935,770 (Fitterman et al), U.S. Pat. No. 5,942,378 (Fitterman et al), all incorporated herein by reference. Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al) and EP-A-0 248,390 (Akio et al).

The compositions of this invention can be used in both what are known as "slow access" and "rapid access" processing methods and equipment. For example, black-and-white motion picture films, industrial radiographic films and professional films and papers are generally developed over a longer period of time (for example, for at least 1 minute and up to 12 minutes). Total processing including other steps (for example fixing and washing) would be even longer. "Rapid access" methods are generally used to process medical radiographic X-ray films, graphic arts films and microfilms and development may be at least 10 seconds and up to 60 seconds (preferably from about 10 to about 30 seconds). The total processing time (for example including fixing and washing) is as short as possible, but generally from about 20 to about 120 seconds. An example of a "rapid access" system is that commercially available as the KODAK RP X-OMATT™ processing system that also includes a conventional photographic fixing composition.

For either type of processing method, the development temperature can be any temperature within a wide range as known by one skilled in the art, for example from about 15 to about 50° C.

The black-and-white photographic silver halide elements processed using the present invention are generally composed of a conventional flexible, transparent film support (polyester, cellulose acetate or polycarbonate) that has applied to each side one or more photographic silver halide emulsion layers. For radiographic films, it is conventional to use blue-tinted support materials to contribute to the blue-black image tone sought in fully processed films. Polyethylene terephthalate and polyethylene naphthalate are preferred film supports.

In general, such elements, emulsions, and layer compositions are described in many publications, including *Research Disclosure*, publication 36544, September 1994. *Research Disclosure* is a publication of Kenneth Mason Publications, Ltd., Dudley House, 12 North Street, Emsworth, Hampshire PO10 7DQ England.

The support can take the form of any conventional element support. Useful supports can be chosen from among those described in *Research Disclosure,* September 1996, Item 38957 XV. Supports and *Research Disclosure,* Vol. 184, August 1979, Item 18431, XII. Film Supports. They can be transparent or translucent polymeric film supports, or opaque cellulosic papers. The support is preferably a transparent film support. In its simplest possible form the film support consists of a material chosen to allow direct adhesion of the hydrophilic silver halide emulsion layers or other hydrophilic layers. More commonly, the support is itself hydrophobic and subbing layers are coated thereon to facilitate adhesion of the hydrophilic silver halide emulsion layers.

The photographic materials include one or more silver halide emulsion layers that comprise one or more types of silver halide grains responsive to suitable electromagnetic radiation. Such emulsions include silver halide grains composed of, for example, silver bromide, silver iodobromide, silver chlorobromide, silver iodochlorobromide, and silver chloroiodobromide, or any combinations thereof. The silver halide grains in each silver halide emulsion unit (or silver halide emulsion layers) can be the same or different, or mixtures of different types of grains.

The silver halide grains can have any desired morphology (for example, cubic, tabular, octahedral), or mixtures of grains of various morphologies. In some embodiments, at least 50% (and preferably at least 70%) of the silver halide grain projected area is provided by tabular grains having an average aspect ratio greater than 8, and preferably greater than 12.

Imaging contrast can be raised by the incorporation of one or more contrast enhancing dopants. Rhodium, cadmium, lead and bismuth are all well known to increase contrast by restraining toe development. Rhodium is most commonly employed to increase contrast and is specifically preferred.

A variety of other dopants are known, individually and in combination, to improve contrast as well as other common properties, such as speed and reciprocity characteristics. Dopants capable providing "shallow electron trapping" sites commonly referred to as SET dopants are specifically contemplated. SET dopants are described in *Research Disclosure,* Vol. 367, November 1994, Item 36736. Iridium dopants are very commonly employed to decrease reciprocity failure. A summary of conventional dopants to improve speed, reciprocity and other imaging characteristics is provided by *Research Disclosure,* Item 36544, cited above, Section I. Emulsion grains and their preparation, sub-section D. Grain modifying conditions and adjustments, paragraphs (3), (4) and (5).

Low COV emulsions can be selected from among those prepared by conventional batch double-jet precipitation techniques. A general summary of silver halide emulsions and their preparation is provided by *Research Disclosure,* Item 36544, cited above, Section I. Emulsion grains and their preparation. After precipitation and before chemical sensitization the emulsions can be washed by any convenient conventional technique using techniques disclosed by *Research Disclosure,* Item 36544, cited above, Section III. Emulsion washing.

The emulsions can be chemically sensitized by any convenient conventional technique as illustrated by *Research Disclosure*, Item 36544, Section IV. Chemical sensitization. Sulfur and gold sensitization is specifically contemplated.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 36544, Section VII Antifoggants and stabilizers, and Item 18431, Section II. Emulsion Stabilizers, Antifoggants and Antikinking Agents.

The silver halide emulsion and other layers forming the layers on the support contain conventional hydrophilic colloid vehicles (peptizers and binders) that are typically gelatin or a gelatin derivative (identified herein as "gelatino-vehicles"). Conventional gelatino-vehicles and related layer features are disclosed in *Research Disclosure*, Item 36544, Section II. Vehicles, vehicle extenders, vehicle-like addenda and vehicle related addenda. The emulsions themselves can contain peptizers of the type set out in Section II noted above, paragraph A. Gelatin and hydrophilic colloid peptizers. The hydrophilic colloid peptizers are also useful as binders and hence are commonly present in much higher concentrations than required to perform the peptizing function alone. The gelatino-vehicle extends also to materials that are not themselves useful as peptizers. The preferred gelatino-vehicles include alkali-treated gelatin, acid-treated gelatin or gelatin derivatives (such as acetylated gelatin and phthalated gelatin). Depending upon the use of the materials, the binder-containing layers can be hardened or unhardened.

Some photographic materials can include a surface overcoat on each side of the support that are typically provided for physical protection of the emulsion layers. In addition to vehicle features discussed above the overcoats can contain various addenda to modify the physical properties of the overcoats. Such addenda are illustrated by *Research Disclosure*, Item 36544, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of surface overcoat addenda, such as anti-matte particles, in the interlayers.

Representative black-and-white papers and films that can be processed using the present invention include, but are not limited to, KODAK TRI-X-PAN Black and White Film, KODAK PLUS X-PAN Black and White Film, KODAK TMAX 100 and 400 speed Black and White Films, KODAK POLYMAX II RC Black and White Papers, KODAK KODABROME II RC F Black and White Paper, KODAK PMAX Art RC V Black and White Paper, KODAK POLY-CONTRAST III RC Black and White Paper, KODAK PANALURE Select RC Black and White Paper, KODAK POLYMAX FINE ART Black and White Papers, KODAK AZO Black and White Papers, ILFORD MULTIGRADE IV RC and FB Black and White Papers, ILFORD ILFO-BROME GALARIE Black and White Papers, and AGFA MULTICONTRAST CLASSIC, PREMIUM Black and White Papers, various KODAK T-MAT Radiographic Films, various KODAK INSIGHT Radiographic Films, KODAK X-OMAT Duplicating Film, various KODAK EKTASCAN Radiographic Films, KODAK CFT, CFL, CFS and CFE Radiographic Films, KODAK EKTASPEED and EKTASPEED PLUS Dental Films and KODAK ULTRASPEED Dental Film.

The black-and-white developing composition can also be used in the first development step to provide color positive images using color reversal photographic silver halide materials.

Such materials are usually processed using the following sequence of processing steps: first (or black-and-white) development, washing, reversal reexposure, color development, bleaching, fixing, washing and/or stabilizing. Another useful process has the same steps, but stabilizing is carried out between color development and bleaching. Such conventional steps are described, for example, in U.S. Pat. No. 4,921,779 (Cullinan et al), U.S. Pat. No. 4,975,356 (Cullinan et al), U.S. Pat. No. 5,037,725 (Cullinan et al), U.S. Pat. No. 5,523,195 (Darmon et al) and U.S. Pat. No. 5,552,264 (Cullinan et al) for the processing of color reversal films (using the conventional Process E-6). Other details are provided in *Research Disclosure,* publication 38957 (noted above), and references noted therein.

Color reversal films used in the practice of this invention are comprised of a support having thereon a plurality of photosensitive silver halide emulsion layers that can contain any conventional silver halide (or mixture thereof). Such films generally have silver halide emulsions having at least 1 mol % iodide based on total silver.

Useful supports are well known and include polyester films, polycarbonate films and cellulose acetate films. The silver halide layers include conventional binder materials, and other conventional addenda. Some specific commercially available color reversal photographic films that can be processed using this invention include EKTACHROME and KODACHROME Color Reversal Films (Eastman Kodak Company), FUJICHROME Color Reversal Films (Fuji Photo Film Co., Ltd.), AGFACHROME Color Reversal Films (AGFA), KONICACHROME Color Reversal Films (Konica) and SCOTCHCHROME Color Reversal Films (Imation).

Photographic reversal compositions are also known in the art, including for example U.S. Pat. No. 3,617,282 (Bard et al) and U.S. Pat. No. 5,736,302 (Buongiorne et al), both incorporated herein by reference.

The color development is generally accomplished with a color developing composition containing the chemical components conventionally used for that purpose, including color developing agents, buffering agents, metal ion sequestering agents, optical brighteners, halides, antioxidants, sulfites and other compounds readily apparent to one skilled in the art. Examples and amounts of such components are well known in the art, including for example U.S. Pat. No. 5,037,725 (Cullinan et al) and U.S. Pat. No. 5,552,264 (Cullinan et al).

Another useful composition for color reversal processing is a composition that provides dye image stabilization. If in liquid form, this composition generally includes a dye stabilization compound (such as an alkali metal formaldehyde bisulfite, hexamethylenetetramine and various formaldehyde releasing compounds), buffering agents, bleach-accelerating compounds, secondary amines, preservatives, and metal sequestering agents. All of these compounds are well known in the art, including U.S. Pat. No. 4,839,262 (Schwartz), U.S. Pat. No. 4,921,779 (Cullinan et al), U.S. Pat. No. 5,037,725 (Cullinan et al), U.S. Pat. No. 5,523,195 (Darmon et al) and U.S. Pat. No. 5,552,264 (Cullinan et al).

A final rinse composition generally has a pH of from about 5 to about 9 (in liquid form), and can include one or more surfactants (anionic, nonionic or both), biocides and buffering agents as is well known in the art. See for example, U.S. Pat. No. 3,545,970 (Giorgianni et al), U.S. Pat. No. 5,534,396 (McGuckin et al), U.S. Pat. No. 5,645,980 (McGuckin et al), U.S. Pat. No. 5,667,948 (McGuckin et al) and U.S. Pat. No. 5,716,765 (McGuckin et al).

Advantageously, the black-and-white developing composition of this invention can be included as part of a processing kit that includes one or more additional photographic processing compositions needed for providing the desired images. For example, additional photoprocessing compositions include photographic fixing compositions for processing black-and-white photographic materials, or photographic color developing, bleaching, fixing and reversal compositions for processing color reversal photographic materials. The kit may also include washing solutions, instructions, fluid or composition metering devices, or any other conventional components of a photographic processing kit. All of the components can be suitably packaged in dry or liquid form in glass or plastic bottles, fluid-impermeable packets or vials.

The following examples are provided for illustrative purposes and are not to be considered limiting in any manner.

EXAMPLE 1

The two photographic black-and-white developing compositions described in TABLE I below (amounts in mol/l), with (Invention) and without (Control A) a stabilizing agent, were aerated at 325 ml/min. at room temperature in an open glass container. Each solution was monitored periodically for changes in developing agent, HMMP and pH. TABLE II and FIG. 1 show the changes in developing agent and TABLE III shows the changes in pH. In FIG. 1, the Control A composition data is represented by Curve A and the Invention data are represented by Curve B.

The data indicates that the presence of D-ribose significantly improved the stability of the developing composition by slowing down the loss of developing agent. This was achieved with little change in the composition pH. Very little loss in HMMP was also observed.

TABLE I

| COMPONENT | Control A | Invention |
|---|---|---|
| DTPA, 40% | 0.0034 | 0.0034 |
| Potassium sulfite, 45% | 0.32 | 0.32 |
| Potassium carbonate, 47% | 0.72 | 0.72 |
| Sodium erythrobate | 0.2 | 0.2 |
| HMMP | 0.012 | 0.012 |
| D-ribose | 0 | 0.2 |
| Benzotriazole | 0.0017 | 0.0017 |
| Potassium bromide | 0.034 | 0.034 |
| pH | 10.3 | 10.3 |

DTPA = diethylenetriaminepentaacetic acid
HMMP = 4-hydroxymethyl-4-methyl-1-phenyl-3-pyrazolidone

TABLE II

| Time | Sodium Erythrobate Remaining (%) | |
|---|---|---|
| (hours) | Control A | Invention |
| 0 | 100 | 100 |
| 48 | 92.5 | 94.2 |
| 120 | 84.3 | 91.4 |
| 216 | 72.6 | 84.1 |
| 312 | 59.4 | 67.2 |

EXAMPLES 2–5

In these examples, we evaluated the effect of different levels of the preferred stabilizing agent D-ribose on the stability of ascorbic acid developing compositions. The five photographic black-and-white developing compositions shown in TABLE IV were monitored in replicates under accelerated oxidation at ambient temperature. The amounts are shown as moll concentrations. TABLE V shows the results in ascorbic acid developing agent loss during the evaluations. It is clear that D-ribose was useful over a wide concentration range to improve developing composition stability. This was accomplished with little loss in HMMP and only a small decrease in pH.

TABLE IV

| COMPONENT | Control B | Example 2 | Example 3 | Example 4 | Example 5 |
|---|---|---|---|---|---|
| DTPA, 40% | 0.0034 | 0.0034 | 0.0034 | 0.0034 | 0.0034 |
| Potassium sulfite, 45% | 0.32 | 0.32 | 0.32 | 0.32 | 0.32 |
| Potassium carbonate, 47% | 0.72 | 0.72 | 0.72 | 0.72 | 0.72 |
| Ascorbic acid | 0.2 | 0.2 | 0.2 | 0.2 | 0.2 |
| HMMP | 0.012 | 0.012 | 0.012 | 0.012 | 0.012 |
| D-ribose | 0 | 0.05 | 0.1 | 0.15 | 0.2 |
| Benzotriazole | 0.0017 | 0.0017 | 0.0017 | 0.0017 | 0.0017 |
| Potassium bromide | 0.034 | 0.034 | 0.034 | 0.034 | 0.034 |
| pH | 10.3 | 10.3 | 10.3 | 10.3 | 10.3 |

TABLE V

| Time | Ascorbic Acid Remaining (%) | | | | |
|---|---|---|---|---|---|
| (hours) | Control B | Example 2 | Example 3 | Example 4 | Example 5 |
| 0 | 100 | 100 | 100 | 100 | 100 |
| 120 | 80.4 | 85.0 | 87.7 | 88.2 | 89.8 |
| 216 | 77.3 | 78.4 | 86.6 | 92.8 | 91.3 |
| 312 | 63.7 | 67.5 | 68.8 | 75.8 | 79.7 |

EXAMPLES 6–7

In these examples, we evaluated the effect of frustose and lactose as stabilizing agents in the developing compositions shown in TABLE VI. The losses of ascorbic acid developing agent over time are shown in TABLE VII below. As shown by the data, both frustose and lactose were effective as stabilizing agents.

TABLE VI

| COMPONENT | Control C | Example 6 | Example 7 |
|---|---|---|---|
| DTPA, 40% | 0.0034 | 0.0034 | 0.0034 |
| Potassium sulfite, 45% | 0.32 | 0 | 0.08 |
| Potassium carbonate, 47% | 0.72 | 0.72 | 0.72 |
| Ascorbic acid | 0.2 | 0.2 | 0.2 |
| HMMP | 0.012 | 0.012 | 0.012 |
| D-fructose | 0 | 0.2 | 0 |
| D-lactose | 0 | 0 | 0.2 |
| Benzotriazole | 0.0017 | 0.0017 | 0.0017 |
| Potassium bromide | 0.034 | 0.034 | 0.034 |
| pH | 10.3 | 10.3 | 10.3 |

TABLE VII

| | Ascorbic acid (%) | | |
|---|---|---|---|
| Time (hours) | Control C | Example 6 | Example 7 |
| 0 | 100 | 100 | 100 |
| 120 | 85.2 | 87.6 | 89.8 |
| 216 | 70.2 | 74.9 | 77.5 |
| 312 | 58.7 | 65.3 | 67.2 |

EXAMPLE 8

The developing composition of Example 1 above was used to process imagewise exposed samples of commercially available KODAK POLYMAX II and Ilford MULTIGRADE IV Black and White Papers in the following manner.

The paper samples were developed using 300 ml of the Example 1 developing composition for 1 minute at 21° C., fixed using 400 ml of commercially available KODAK RAPID Fixer (1:3), diluted 1:1, for 2 minutes at ambient temperature, washed with tap water for 5 minutes and dried in the air at room temperature. The desired black-and-white images were obtained in all of the samples.

The invention has been described in detail with particular reference to certain preferred embodiments thereof, but it will be understood that variations and modifications can be effected within the spirit and scope of the invention.

We claim:

1. A photographic processing kit comprising:

an aqueous black-and-white photographic developing composition that is essentially free of dihydroxybenzene compounds and comprises:

a) at least 0.01 mol/l of an ascorbic acid developing agent, b) at least 0.01 mol/l of a mono- or disaccharide, and c) optionally at least 0.01 mol/l of a sulfite preservative, and one or more additional aqueous photographic processing compositions.

2. The processing kit of claim 1 further comprising an aqueous photographic fixing composition.

3. The processing kit of claim 1 wherein said mono- or disaccharide is present in said developing composition in an amount of from about 0.01 to about 0.5 mol/l.

4. The processing kit of claim 1 wherein said developing composition further comprises at least 0.0001 mol/l of a 3-pyrazolidone co-developing agent.

5. The processing kit of claim 1 wherein said developing composition has a pH of from about 7 to about 12 in aqueous form.

6. The processing kit of claim 5 wherein said developing composition has a pH of from about 8 to about 11 in aqueous form.

7. The processing kit of claim 1 wherein said mono- or disaccharide is ribose, fructose, lactose, glucose or galactose.

8. The processing kit of claim 1 wherein said aqueous black-and-white photographic developing composition has a pH of from about 8 to about 11, is essentially free of dihydroxybenzene compounds, and comprises:

a) from about 0.05 to about 0.3 mol/l of an ascorbic acid developing agent, b) from about 0.05 to about 0.25 mol/l of ribose, fructose, lactose, glucose or galactose as a stabilizing agent, c) from 0 to about 0.5 mol/l of a sulfite preservative, d) from about 0.005 to about 0.04 mol/l of a 3-pyrazolidone co-developing agent, and e) an organic antifoggant.

9. A method of providing an image comprising contacting an imagewise exposed silver halide photographic material with the aqueous processing compositions of the processing kit of claim 1.

10. The method of claim 9 wherein said photographic material is a color reversal photographic material.

11. The method of claim 9 wherein said photographic material is a black-and-white photographic film or paper.

* * * * *